US009590345B2

(12) United States Patent
Wollitzer et al.

(10) Patent No.: US 9,590,345 B2
(45) Date of Patent: Mar. 7, 2017

(54) CONTACT ELEMENT FOR TRANSMITTING HIGH-FREQUENCY SIGNALS BETWEEN TWO CIRCUIT BOARDS

(71) Applicant: ROSENBERGER HOCHFREQUENZTECHNIK GMBH & CO. KG, Fridolfing (DE)

(72) Inventors: Michael Wollitzer, Fridolfing (DE); Christian Maier, Griesstätt (DE); Josef Gramsamer, Tittmoning (DE); Sylvester Mühlbacher, Fridolfing (DE); Bernhard Aicher, Fridolfing (DE); Christian Dandl, Fridolfing (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 14/435,807

(22) PCT Filed: Oct. 28, 2013

(86) PCT No.: PCT/EP2013/003240
§ 371 (c)(1),
(2) Date: Apr. 15, 2015

(87) PCT Pub. No.: WO2014/067645
PCT Pub. Date: May 8, 2014

(65) Prior Publication Data

US 2015/0270635 A1 Sep. 24, 2015

(30) Foreign Application Priority Data

Oct. 29, 2012 (DE) ..... 20 2012 010 365 U

(51) Int. Cl.
*H01R 24/50* (2011.01)
*H01R 13/24* (2006.01)
(Continued)

(52) U.S. Cl.
CPC ..... *H01R 13/2407* (2013.01); *H01R 12/71* (2013.01); *H01R 13/17* (2013.01);
(Continued)

(58) Field of Classification Search
CPC ..... H01R 9/096
(Continued)

(56) References Cited

U.S. PATENT DOCUMENTS 4,161,346 A * 7/1979 Cherian ..... H01R 12/714 439/515
4,362,353 A * 12/1982 Cobaugh ..... H01R 23/72 29/882
(Continued)

FOREIGN PATENT DOCUMENTS

DE 102010004396 A1 8/2010
EP 0099633 A1 1/1984

*Primary Examiner* — Neil Abrams
(74) *Attorney, Agent, or Firm* — DeLio, Peterson & Curcio, LLC; Robert Curcio

(57) ABSTRACT

A contact element for electrically conductive collection of components, the contact element having contact points for contacting contact regions of the components and having a first section, formed at least primarily in the shape of a spring tab, that electrically collects the contact points, and having a second section that electrically connects the contact points, wherein the collecting path formed by the second section is shorter than that of the first section.

11 Claims, 6 Drawing Sheets

(51) Int. Cl.
*H01R 12/71* (2011.01)
*H01R 13/17* (2006.01)

(52) U.S. Cl.
CPC ..... *H01R 13/2421* (2013.01); *H01R 13/2457* (2013.01); *H01R 13/2492* (2013.01); *H01R 24/50* (2013.01)

(58) Field of Classification Search
USPC ..... 439/66, 63, 515
See application file for complete search history.

(56) References Cited

U.S. PATENT DOCUMENTS 4,377,320 A 3/1983 Lathrop et al.
4,961,709 A * 10/1990 Noschese ..... H01R 13/2421 439/591
5,807,116 A * 9/1998 Kitatani ..... H01R 23/26 439/581
5,984,693 A * 11/1999 McHugh ..... H05K 7/1069 439/515
6,019,611 A * 2/2000 McHugh ..... H01R 13/2435 439/515
6,146,168 A * 11/2000 Ishii ..... H01R 13/7031 439/188
6,149,467 A * 11/2000 Choy ..... H01R 12/721 439/515
6,227,869 B1 * 5/2001 Lin ..... H05K 7/1069 439/515
6,276,941 B1 * 8/2001 Wu ..... H01R 13/2442 439/515
6,776,668 B1 8/2004 Scyoc et al.
7,048,574 B2 * 5/2006 Shinohara ..... G03B 17/02 439/515
7,134,878 B2 * 11/2006 Zheng ..... H01R 13/2421 439/515
7,167,379 B2 1/2007 DiBene, II et al.
7,238,047 B2 7/2007 Seattele et al.
7,294,022 B1 11/2007 Cheng
7,445,458 B1 * 11/2008 Yamane ..... H01R 4/028 439/63
8,641,449 B2 * 2/2014 Cai ..... H01R 13/6581 439/515
2005/0233606 A1 10/2005 Liao
2006/0035484 A1 2/2006 Hsu
2007/0178719 A1 8/2007 Mendenhall
2007/0287315 A1 12/2007 Kubo
2008/0020638 A1 1/2008 Polnyi
2015/0270635 A1 * 9/2015 Wollitzer ..... H01R 13/2421 439/675

* cited by examiner

CONTACT ELEMENT FOR TRANSMITTING HIGH-FREQUENCY SIGNALS BETWEEN TWO CIRCUIT BOARDS

BACKGROUND OF THE INVENTION

1. Field of the Invention

The invention relates to a contact element for the electrically conductive connection of contact regions situated in opposite positions, and in particular to a contact element by which radio-frequency signals can be transmitted between two components, particularly two printed circuit boards, with as great a freedom from losses as possible. The invention also relates to a contact device having a plurality of such contact elements.

2. Description of Related Art

It is known for a connection to be made between two printed circuit boards by means of two co-axial insertion-type connectors which are solidly connected to the printed circuit boards and an adapter, the so-called "bullet", which connects the two co-axial insertion-type connectors. This adapter allows an axial and radial compensation for tolerances and also allows tolerances on parallelism to be compensated for. Typical co-axial insertion-type connectors used for this purpose are SMP connectors, mini-SMP connectors and FMC connectors.

Alternatively, electric connections are also made between two printed circuit boards by means of spring-loaded contact pins of single-conductor and/or multi-conductor construction.

Also, there is known from U.S. Pat. No. 6,776,668 issued to Scyoc, et al., on Aug. 17, 2004, titled "LOW PROFILE COAXIAL BOARD-TO-BOARD CONNECTOR," a co-axial contact element via is taught which radio-frequency signals are to be transmitted between two printed circuit boards. In this case a center conductor, in the form of a spring-loaded contact pin, acts as a signal conductor, while an outer conductor surrounding the center conductor performs the functions of a return conductor and of shielding for the center conductor. The outer conductor comprises a base body in sleeve form which is slotted more than once in the longitudinal direction. At its end-face, the unslotted end of the base body forms a point of contact to make contact with a contact-making region of one of the printed circuit boards. Displaceably guided on the base body is a sleeve of the outer conductor which at one end, at its end-face, forms a point of contact to make contact with a contact-making region on the other printed circuit board. A pre-loaded spring is supported between the base body and the sleeve. As the two printed circuit boards are being connected, both the head of the center conductor, which center conductor is in the form of a spring-loaded contact pin, and the sleeve of the outer conductor are displaced and thereby subject their respective springs to further pre-loading, whereby secure and reliable contact-making pressure can be produced in spite of any possible tolerances on the distance from one another of the contact-making regions of the printed circuit boards. Because the base body is slotted, it also has a certain flexibility in the lateral direction, what is intended to be achieved thereby being the ability to compensate even for relatively large degrees of non-parallelism between the two contact-making regions.

Also known is the use of simple resilient tongues as contact elements or as parts of contact elements. These have the advantage of being easy to construct and inexpensive to manufacture as, for example, stamped, punched or die-cut, and bent, components. At the same time, resilient tongues perform all the essential functions of contact elements of this kind, namely on the one hand the transmission of power or signals, and also the elastic deformation to obtain an adequate contact-making pressure at the points of contact and to compensate for tolerances on the attitude and position of the components to be connected. What is disadvantageous however is that, due to their principle, resilient tongues extend along an arcuate or angled path and the contact-making regions to be connected electrically are thus not connected in a direct line. The relatively great length of the resilient tongue goes hand in hand with a relatively high impedance and even inductance, which may have an adverse effect in particular on the quality of the transmission of radio-frequency signals.

SUMMARY OF THE INVENTION

Taking the above prior art as a point of departure, the object underlying the invention was to specify an improved contact element for the electrical connection of components. In particular, this connecting element was to be distinguished by good transmission of radio-frequency signals, properties which compensated for tolerances, and/or inexpensive manufacture.

This object is achieved by a contact element and a contact device as defined in the description herein and in the claims. Advantageous embodiments of the contact element according to the invention and of the contact device according to the invention form the subject matter of the respective sets of dependent claims and can be seen from the following description of the invention.

The above and other objects, which will be apparent to those skilled in the art, are achieved in the present invention which is directed to a contact device comprising a plurality of contact elements via each of which two points of contact on an outer conductor of the contact device are connected electrically, the points of contact being intended to make contact with contact-making regions of components, the contact elements each having a first section which connects the points of contact electrically and which is at least partly in the form of a resilient tongue, and second sections at least a section or sections of which are formed by a common conductor and which connect the points of contact electrically, the paths of connection formed by the second sections being shorter than those formed by the first sections. The contact elements are so arranged that their first sections surround their second sections annularly.

The first sections of a first subset of the contact elements surround the second sections of the contact elements annularly and the first sections of a second subset of the contact elements surround the first sections of the first sub-set annularly. The first sections of the first subset of the contact elements and the first sections of the second subset thereof are offset in rotation from one another. The first sections of the contact elements project beyond one end of the common conductor. The first sections of the contact elements rest against a section of the common conductor under spring loading and are movable relative thereto.

The common conductor is of a rigid form and focus, at a first end, a point of contact for contact with a first one of the contact-making regions, and the first sections of the contact elements, in the form of resilient tongues, are fastened to the common conductor.

The common conductor surrounds a center conductor and is electrically insulated therefrom. The center conductor takes the form of a spring-loaded contact pin.

In a second aspect, the present invention is directed to a contact element for the electrically conductive connection of components, having points of contact for making contact with contact-making regions of the components and having a first section which connects the points of contact electrically and which is at least partly in the form of a resilient tongue, and a second section which connects the points of contact electrically, the path of connection formed by the second section being shorter than that formed by the first section and being of as short a length as possible in order to connect the contact-making regions of the components to be connected electrically in as direct a line as possible.

The first section and second section are integrally formed in the form of one resilient tongue. The second section comprises subsections which slide against one another if there is a deformation of the first section.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
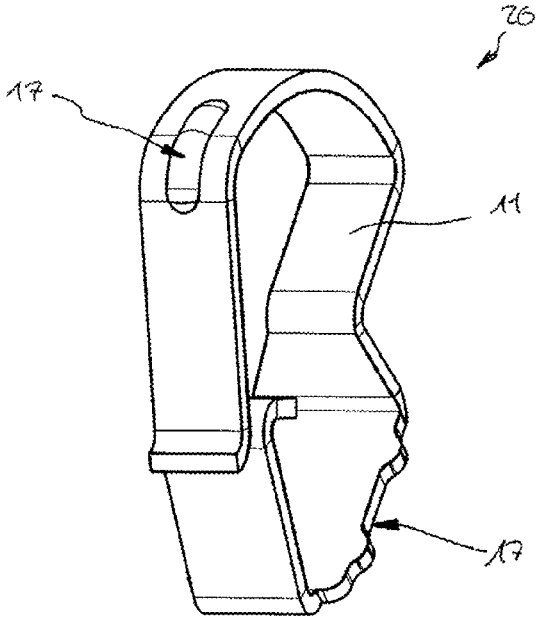
FIG. 1 is a perspective view of an embodiment of contact element according to the invention in the unloaded state.
Figure 2:
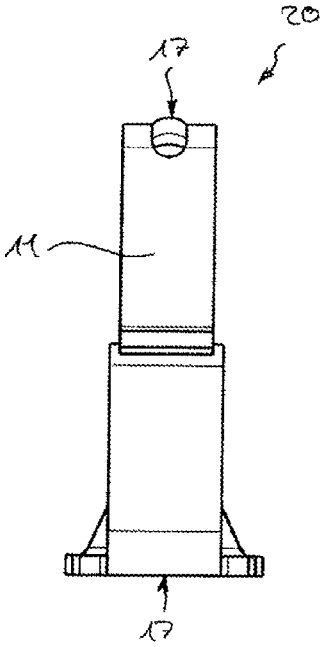
FIG. 2 is a view from the front of the contact element shown in FIG. 1.
Figure 3:
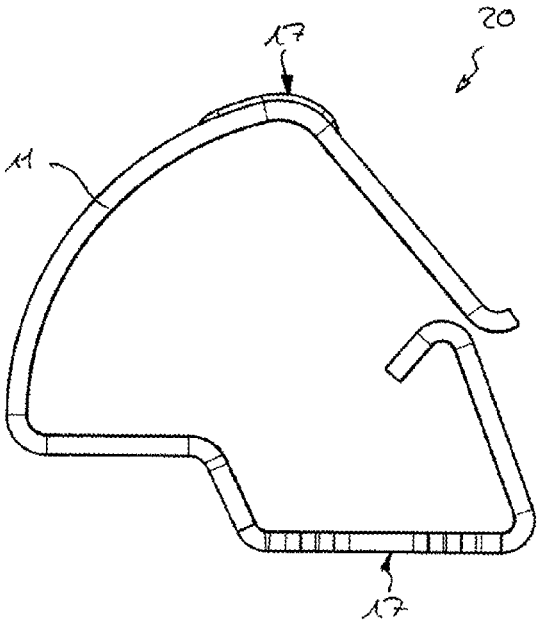
FIG. 3 is a view from the side of the contact element shown in FIGS. 1 and 2.
Figure 4:
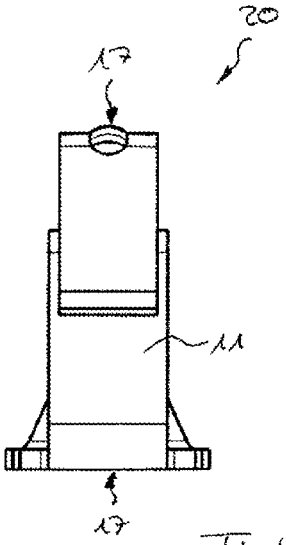
FIG. 4 is a view from the front of the contact element shown in FIGS. 1 to 3 in the loaded state.
Figure 5:
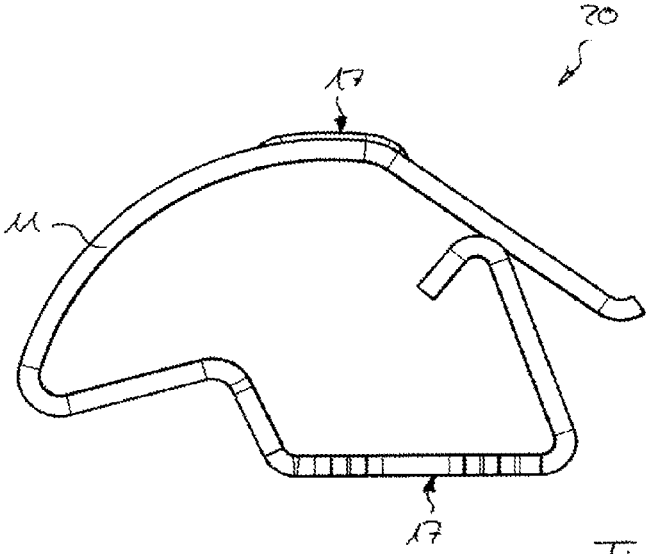
FIG. 5 is a view from the side of the contact element shown in FIG. 4.

In describing the preferred embodiment of the present invention, reference will be made herein to FIGS. 1-13 of the drawings in which like numerals refer to like features of the invention.

Contact elements are intended to ensure that the radio-frequency signals are transmitted with as great a freedom from losses as possible, even within a defined range of tolerances where the tolerances are on the parallelism of the two printed circuit boards and on the axial distance between them. Even a radial offset between the contact-making regions is to be compensated for if required. Further requirements to be met by contact elements of this kind lie in the areas of inexpensive manufacture and, where necessary, easy fitting. Also, the axial and radial dimensions of the contact elements are to be as small as possible.

The idea underlying the invention is to improve a contact element in the form of a resilient tongue by providing—as well as the path of connection through the resilient tongue itself—an additional path of connection which connects the contact-making regions of the components to be connected electrically in as direct a line as possible and which is therefore of the shortest possible length.

A contact element according to the invention for the electrically conductive connection of components therefore has points of contact for making contact with said contact-making regions and also comprises a first section which connects the points of contact electrically and which is at least partly in the form of a resilient tongue. Also provided is a second section which connects the points of contact electrically, the path of connection formed by this latter being shorter than that formed by the first section.

What is meant by "resilient tongue" for the purposes of the invention is a component of preferably mainly two-dimensional extent (of a thickness which is only a fraction of its width and length, with its width preferably also being only a fraction of its length) which extends into a free space from a point of connection at which it is solidly connected to another component, said component being deflected elastically when there is a pressure on the area defined by its length and width and thus providing a functional resilient action.

The design according to the invention of a contact element creates a path of connection which is short and which is therefore distinguished by low impedance. The inductance of the contact element according to the invention is also comparatively low, which has a positive effect on the transmission of radio-frequency signals.

Despite these good electrical properties, it is possible for the contact element according to the invention to be distinguished by extremely simple construction and the ability to be manufactured inexpensively, in particular as a stamped, punched or die-cut, and bent, component. This is particularly true when, in a preferred embodiment, the first section and second section of the contact element are integrally formed in the form of one resilient tongue. The contact element according to the invention may thus take the form of a single resilient tongue which, due to its shaping, has a first section which primarily, as a result of elastic deformation, ensures the contact-making pressure at the points of contact and a compensation for tolerances, whereas a shorter second section acts primarily to transmit power or signals.

It must be possible for a relative movement of the points of contact on the contact element due to an elastic deformation of the first section to be compensated for by the second section. This may take place as a result of an appropriate elastic deformation of the second section. Provision is however preferably made for the second section to comprise sub-sections which slide against one another when there is a deformation of the first section. This embodiment may have the advantage that the length of the path of connection always adjusts to the actual distance between the points of contact.

A contact device according to the invention is characterized in that it comprises a plurality of contact elements according to the invention.

The contact elements are preferably so arranged in this case that their first sections surround their second sections (or at least a section or sections thereof) annularly. Good contact can be ensured in this way with comparatively large contact-making regions on the components between which contact is to be made. Because, when this is the case, each point of contact is also able to yield individually as a result of a corresponding deformation of the associated first section, even comparatively large tolerances (in particular on parallelism) to which the contact-making regions to be connected are subject can be compensated for by a contact device of this kind.

When the contact device is designed as a co-axial contact device in which the contact elements form an outer conductor which surrounds a center conductor, shielding may be produced for the center conductor by arranging the first sections of the contact elements to be of a (preferably circular) annular form.

Particularly to further improve the shielding action performed by the first sections of the contact elements, provision may also be made for these latter to be arranged around the second sections as a double annulus and for them thereby to form a double shield to a certain degree. Hence the first sections of a first subset of the contact elements would surround the second sections of the contact elements annularly and the first sections of a second sub-set of the contact elements would surround the first sections of the first subset annularly.

In this case, the first sections of one annulus (which first sections are, furthermore, preferably each arranged at a uniform spacing) may be offset in rotation (preferably by half the spacing) from the first sections of the second annulus, the gaps formed between the first sections of an annulus (as seen from the second sections) thus being hidden (at least partly) by the first sections of the other annulus.

In one embodiment of the contact device according to the invention, provision may be made for at least a section or sections of the second sections of the contact elements to be formed by a common conductor. This may have advantages particularly with regard to manufacture and fitting.

Furthermore, provision may be made in this case for the common conductor to be of a rigid form and to form, at a first end (along the longitudinal axis), a point of contact for contact with a first one of the contact-making regions, and for the second sections of the contact elements, in the form of resilient tongues, to be fastened to the common conductor. The resilient tongues then preferably form the points of contact for contact with (at least) one second contact-making region.

Provision may also be made in this case for the first sections of the contact elements to project beyond a second end (along the longitudinal axis) of the common conductor, in which case the points of contact are, furthermore, preferably formed by the projecting sections of the resilient tongues. When a contact-making surface with which contact is to be made by the points of contact on the resilient tongues lies in a plane, this ensures that adequate travel in deformation is provided for the resilient tongues and that the corresponding second end of the common conductor along the longitudinal axis is prevented from coming into contact with the contact-making region.

In an embodiment of the contact device according to the invention which is also preferred, provision may be made for the resilient tongues to rest against (at least) one section of the common conductor under spring loading and to be movable relative thereto.

In one embodiment of the resilient tongues, provision may also be made for their free ends to point in the direction of the first end of the common conductor (and hence in the direction of that end of the common conductor to which they are fastened), and for central sections of the resilient tongues to form the points of contact. Furthermore, provision may then preferably be made for the resilient tongues to rest against the common conductor in the region of their free ends.

In an alternative embodiment of the resilient tongues, provision may be made for the free ends of the resilient tongues to point in the direction of the second end and for the points of contact to make contact with the associated contact-making region to be formed in the region of the free ends. Furthermore, provision may then be made for central sections of the resilient tongues to rest against the common conductor.

The possibility does of course exist of both these embodiments of the resilient tongues being combined in a contact device according to the invention.

To simplify the manufacturability of a contact element according to the invention or a contact device according to the invention, provision may be made for the resilient tongues of the contact elements to comprise two sections which are offset laterally and which overlap in a section along the longitudinal axis and are connected there (preferably in one piece). This particularly simplifies the use of a bending tool when a cage of resilient tongues which creates the resilient tongues is being manufactured as a stamped, punched or die-cut, and bent, component.

The contact device according to the invention preferably takes the form of a co-axial contact device having a center conductor and an outer conductor surrounding the center conductor. A particular preference in this case is for provision to be made for the outer conductor to be formed in accordance with the invention whereas, as a further preference, the center conductor may take the form of a spring-loaded contact pin.

The contact element according to the invention and the contact device according to the invention may advantageously be used to transmit radio-frequency signals between components and in particular printed circuit boards, with the center conductor preferably being used as a signal conductor and the outer conductor as a return conductor and/or shielding in an embodiment as a co-axial contact device.

The contact element shown in FIGS. 1 to 5 is of a one-piece form in the form of a resilient tongue 11 made of electrically conductive material (and in particular of a metal). The contact element creates two points of contact 17 which are intended to make contact with contact-making regions of two components, and in particular two printed circuit boards, which are to be connected electrically via one or more of the contact elements. One of the points of contact 17 (the one at the bottom in FIGS. 1 to 5) is comparatively large in area. Via this point of contact 17, the contact element is intended to be connected, and in particular soldered or brazed, solidly to the associated contact-making region of a component. The second point of contact 17, which is more of a point or linear form, is intended by contrast to make free contact with the associated contact-making region of a component, i.e., to do so only under a contact-making pressure exerted as a result of an elastic deformation of the contact element.

A first section of the contact element, which connects the two points of contact 17 electrically, is responsible primarily for generating the contact-making pressure. Movement towards one another of the points of contact results in an elastic deformation of this first section, as can be seen in particular in FIG. 5.

A second section comprises two sub-sections each of which comprises one of the free ends of the resilient tongue 11. On a first, comparatively small, deformation of the first section, the two sub-sections come into contact and thus likewise connect the two points of contact 17 together electrically. This creates a primary path for the radio-frequency signals to be transmitted via the contact element, said primary path being appreciably shorter than the path which is formed by the first section. If there is further deformation of the first section the two sub-sections slide against one another. As they do so the length of the path of connection is reduced.

The contact devices shown in FIGS. 6 to 11 each comprise a center conductor 1, an outer conductor 2 and an insulating member 3 arranged between the center conductor 1 and the outer conductor 2.

The center conductor 1 takes in each case the form of a spring-loaded contact pin, i.e., it comprises an electrically conductive sleeve 4 and an electrically conductive head 5 having a spherical contact-making surface, part of which head 5 is guided within the sleeve 4 to be movable. Arranged inside the sleeve 4 is a spring 6 which is supported between the head 5 and the floor of the sleeve 4. The center conductor 1 is immovably mounted within a receiving opening in the insulating member 3. The center conductor 1 may in particular be connected to the insulator 3 in this case by being physically united therewith, e.g., by adhesive bonding. The floor end of the sleeve 4 remote from the head 5 forms a contact-making surface which acts as a point of contact 17 to make contact with a contact-making region of an underlying printed circuit board (not shown).

The outer conductor 2 comprises in principle a plurality of contact elements according to the invention and comprises one common conductor 7 which entirely surrounds the circumferential surface of the insulator 3 and which partly surrounds the latter's end-faces. As a result, the common conductor 7 too is immovably connected to the insulating member 3. As well as this possibility of a connection by interengagement, provision may also be made, alternatively or in addition, for a connection by friction or physical union.

The common conductor 7 comprises a base part 8 and a sleeve part 9 which is solidly connected thereto (in particular by physical union, e.g., by soldering, brazing or welding).

On the side remote from the insulator 3, the base part 8 forms a contact-making surface which acts as a point of contact 17 to make contact with a contact-making region of an underlying printed circuit board.

That end of the sleeve part 9 which is connected to the base part 8 comprises a surrounding projection 10 to which an electrically conductive cage of resilient tongues is fastened (preferably by physical union and in particular by soldering or brazing). The cage of resilient tongues creates a plurality (actually eight in this case) of resilient tongues 11 which, starting from an annular section 12 which is radially directed relative to the sleeve part 9 and via which the cage of resilient tongues is connected to the common conductor 7, are distributed around the circumference of said annular section 12 at a uniform spacing and extend in an arcuate form in the longitudinal direction of the contact device.

The three embodiments of contact device according to the invention which are shown in FIGS. 6 to 11 differ in the shape of their resilient tongues 11 and in the position of the points of contact 17 formed by these latter.

Figure 6:
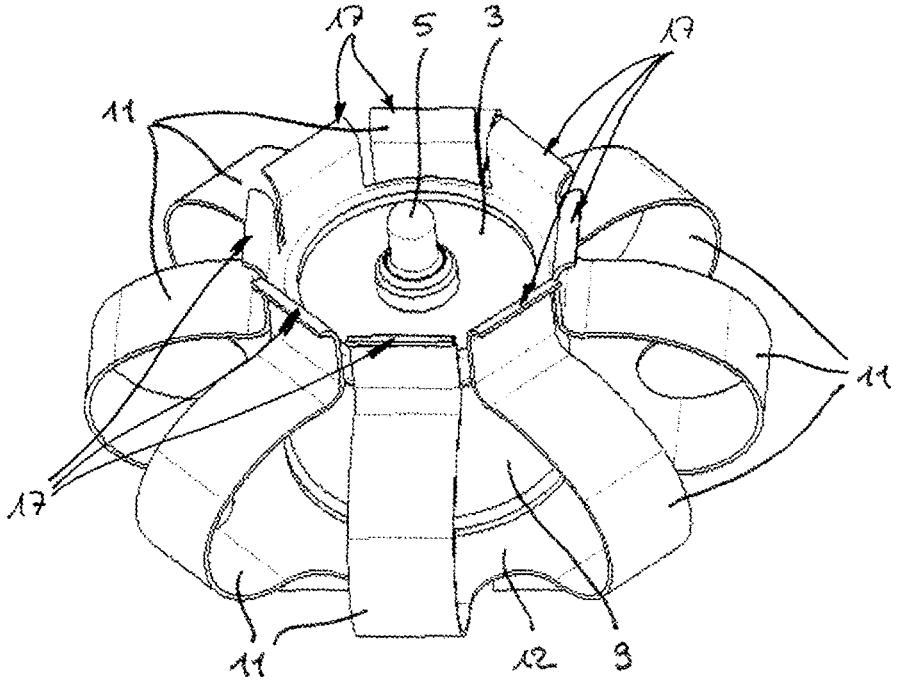
FIG. 6 is a perspective view of a second embodiment of the contact device according to the invention.
Figure 7:
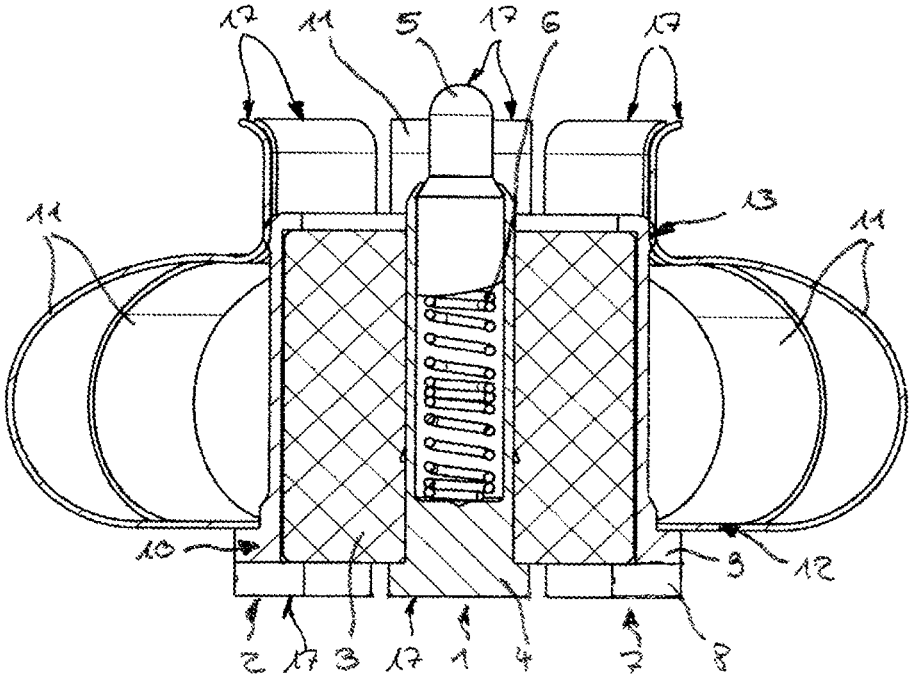
FIG. 7 is a longitudinal section through the contact device shown in FIG. 6.

In the embodiment shown in FIGS. 6 and 7 the resilient tongues 11 each extend—starting from the outer edge of the annular section 12—in an almost semi-circular arc which merges into a portion angled at approximately 90°. In the sections of the resilient tongues 11 which follow on from this, in which the latter already project beyond the common conductor 7, they extend approximately in parallel. Finally, the free ends of the resilient tongues 11 are of a form where they are also bent outwards. These bent ends form the points of contact 17 by which the outer conductor 2 is able to make contact with a contact-making region of a target printed circuit board (not shown), which contact-making region is plane and aligned substantially perpendicularly to the longitudinal axis of the contact device.

In those sections of the resilient tongues 11 which extend parallel to one another, the latter rest against a surrounding projection 13 (of semi-circular cross-section) from the sleeve part 9 of the common conductor 7. They rest in this way under spring loading, which is applied by the resilient tongues 11 themselves.

Figure 8:
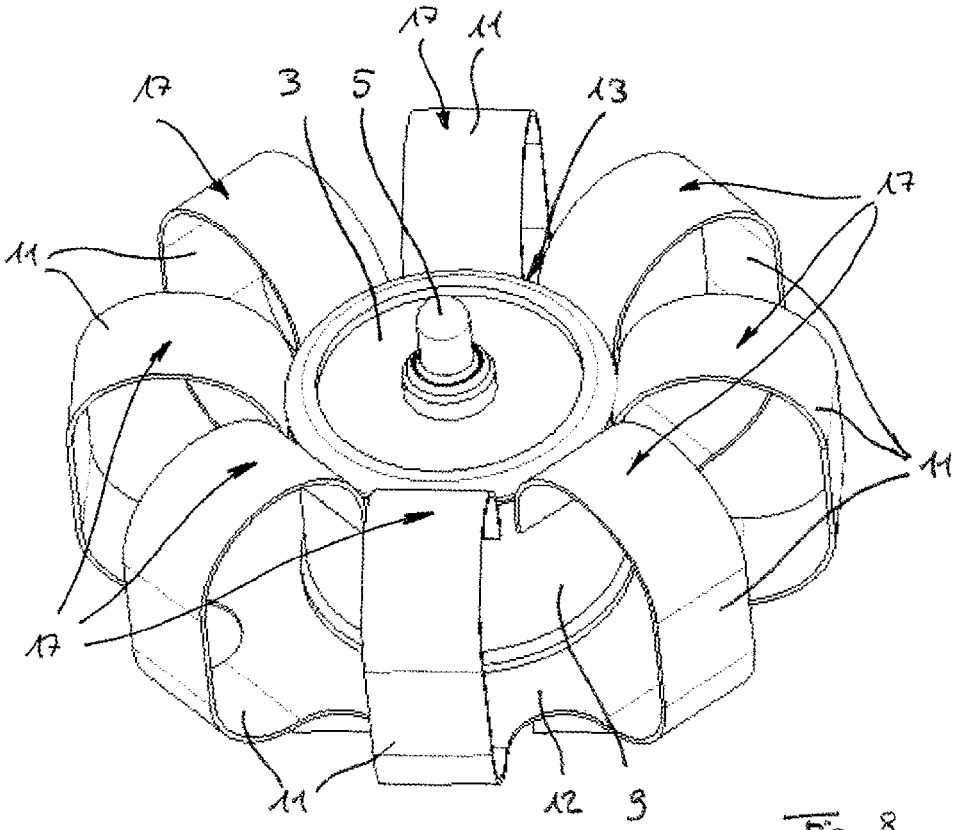
FIG. 8 is a perspective view of a third embodiment of the contact device according to the invention.
Figure 9:
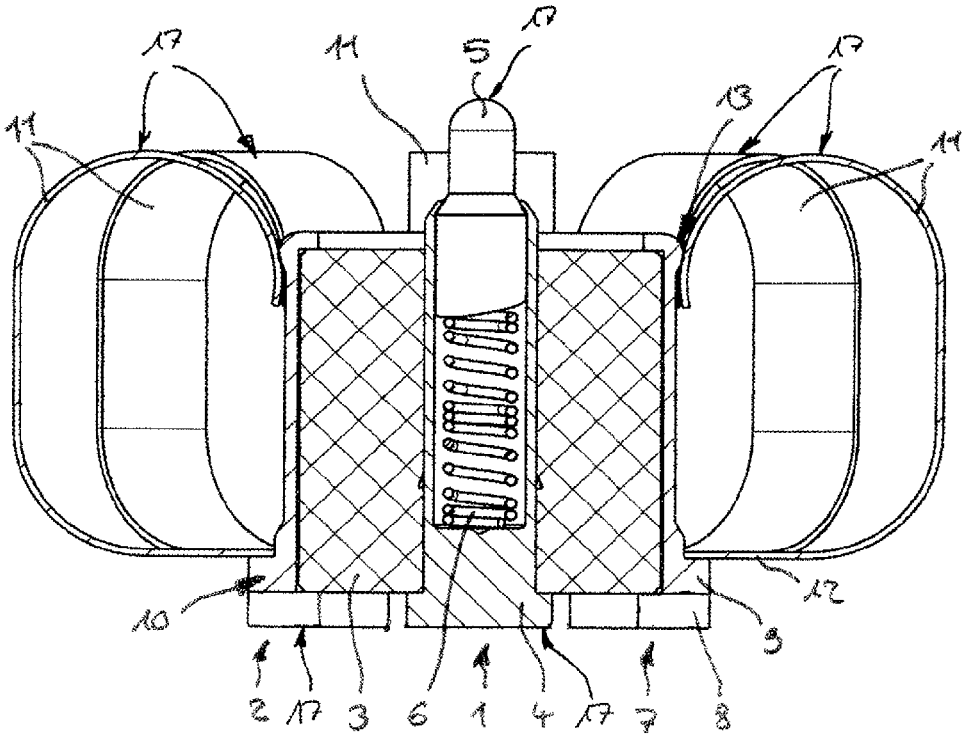
FIG. 9 is a longitudinal section through the contact device shown in FIG. 8.

In the embodiment shown in FIGS. 8 and 9, the resilient tongues 11—beginning from the outer edge of the annular section 12—first extend through a 90° arc and then merge into a section in which they extend almost in parallel. Approximately on a level with the upper end of the common conductor 7, this section merges into a 180° arc. The points of contact 17 by which the outer conductor 2 is able to make contact with a contact-making region of the target printed circuit board are situated approximately in the center of the section forming the 180° arc. The resilient tongues 11 rest against the common conductor 7 under spring loading and this takes place in the region or vicinity of their free ends.

Figure 10:
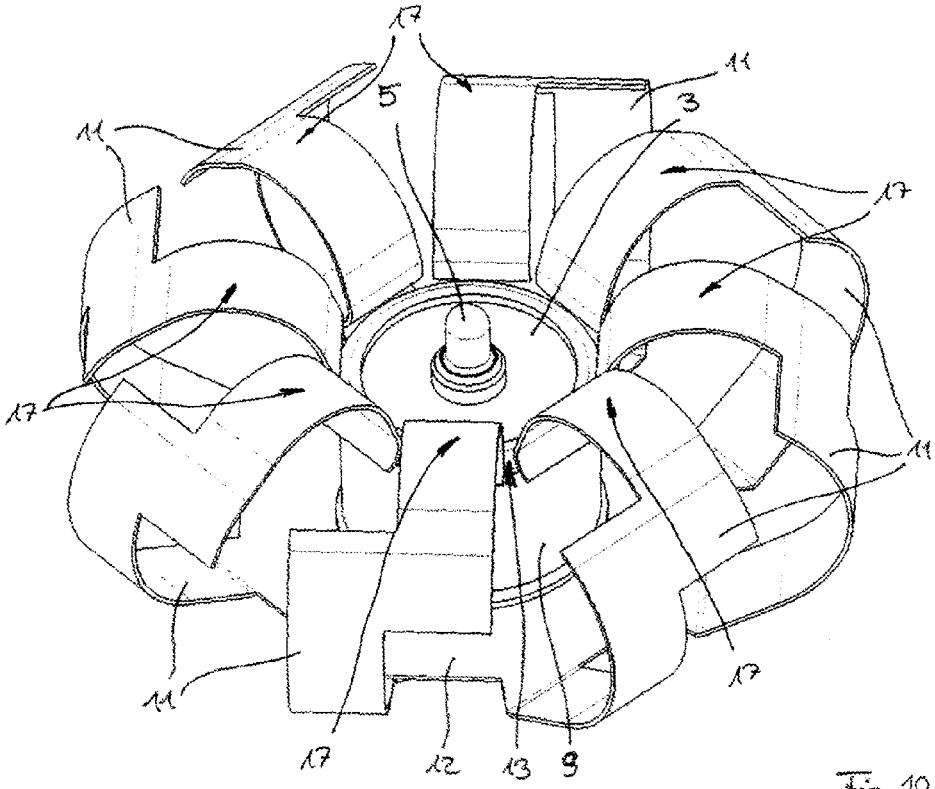
FIG. 10 is a perspective view of a fourth embodiment of the contact device according to the invention.
Figure 11:
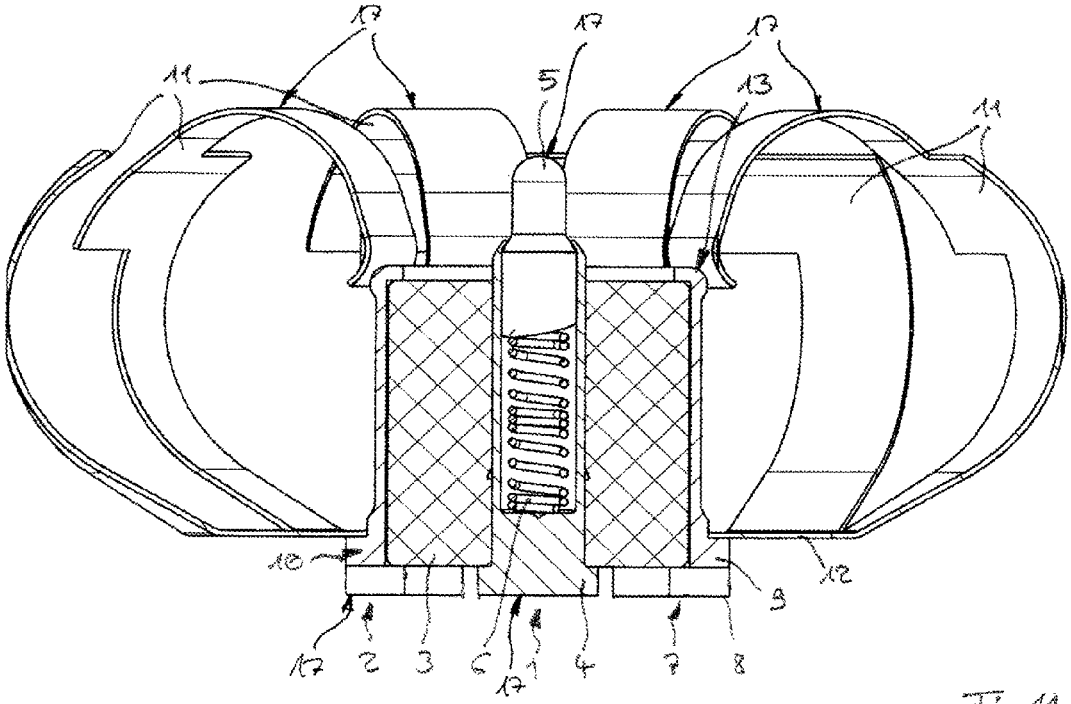
FIG. 11 is a longitudinal section through the contact device shown in FIG. 10.

In the embodiment shown in FIGS. 10 and 11 the resilient tongues extend in a similar way to those of the embodiment shown in FIGS. 8 and 9, although in this case there is no central section provided in which they are aligned approximately in parallel. Instead, the resilient tongues 11—beginning from the outer edge of the annular section 12—extend in an arc of more or less continuous curvature which extends over approximately 270°.

The resilient tongues 11 of the embodiment shown in FIGS. 10 and 11 also differ from those of the embodiment shown in FIGS. 8 and 9 in their two-dimensional shape. Whereas the latter are each formed by a single bent strip of substantially constant width, the resilient tongues 11 of the contact device shown in FIGS. 10 and 11 are of a two-dimensional shape in which two bent sub-strips are arranged to be offset laterally, these sub-strips also overlapping in a section along their longitudinal axis where they are connected together in one piece. This embodiment may simplify the manufacture of the cage of resilient tongues as a stamped, punched or die-cut, and bent, component because each lateral offset creates space for the entry of a bending tool to do work on one of the sub-strips.

Figure 12:
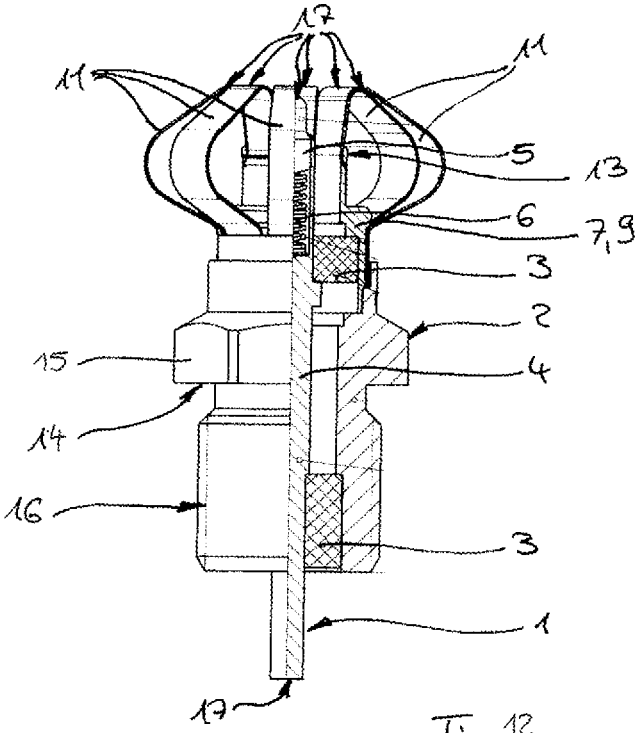
FIG. 12 is a view partly in section of a fifth embodiment of the contact device according to the invention.
Figure 13:
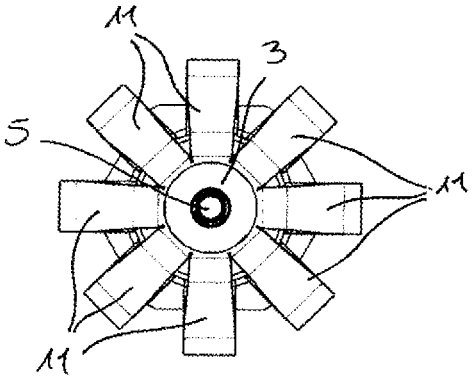
FIG. 13 is a plan view of the contact device shown in FIG. 12.

The contact device shown in FIGS. 12 and 13 has resilient tongues 11 which substantially correspond to those of the contact device shown in FIGS. 8 and 9 in respect of their configuration. A material difference between this contact device and that shown in FIGS. 6 to 11 is the connection of the common conductor 7 to a connecting conductor 14 which forms a nut 15 and an outside thread 16. By means of this outside thread 16, the contact device can be fixed in an opening in a housing (not shown). The sleeve 4 of the center conductor 1 is of a form which is lengthened to suit and projects beyond the free end of the connecting conductor 14.

In the contact devices shown in FIGS. 6 to 13, the resilient tongues 11 each form part of a first section of a contact element according to the invention. By means of them, the two points of contact 17 of the outer conductor 2 of the contact device are connected electrically, the primary functions being the generation of a contact-making pressure at the upper points of contact and compensation for tolerances on the attitude and alignment of the contact-making regions of the components to be connected. Because the lower point of contact 17 is formed by the underside of the base part 8 (or by the connecting conductor 14 in the case of contact device shown in FIGS. 12 and 13), the base part 8 (or the connecting conductor 14, as the case may be), a part of the sleeve part 9, and the annular section 12 are likewise part of the first section of each of the contact elements. A second section of the individual contact elements, which serves primarily to make the electrical connection, is formed by the common conductor 7 and the respective parts of the resilient tongues 11 which extend between the surrounding projection 13 from the sleeve part 9 and the respective points of contact 17 on the resilient tongues 11.

A material advantage of the contact device according to the invention which is shown in FIGS. 6 to 13 is that the path of connection which is formed by the second sections of the contact elements forming the outer conductor 2 is always substantially of exactly the same length as the signal path through the center conductor 1, whereby it is possible to obtain a suitably equal signal path.

The distance between the two printed circuit boards between which an electrically conductive connection is to be made by means of one or more of the contact devices shown in FIGS. 6 to 13, is preferably selected to be sufficiently large for both the center conductor 1 of the contact device(s) arranged between them and also the outer conductor 2 thereof to be compressed. Hence, in the first place the head 5 of the center conductor 1 is displaced a short distance towards the floor of the sleeve 4 in opposition to the force exerted by the spring 6, which latter is thereby pre-loaded to a greater degree, while the resilient tongues 11 of the outer conductor 2 are compressed in the direction defined by the longitudinal axis of the contact device, which involves a reduction in their radius of curvature, or rather their radii of curvature, and hence an increasing pre-loading of the resilient tongues 11. The intended compression of the contact devices between the printed circuit boards is preferably selected not to be so large that the target printed circuit board touches the upper edges of the sleeve 4 of the center conductor 1 or those of the sleeve part 9 of the outer conductor 2.

All in all, there is thus provided for both the center conductor 1 and the outer conductor 2 of the contact devices a "resilient travel" in both directions by which departures from the desired size of the inter-board distance in both directions (its being larger or smaller) can be compensated for. Such departures may, in particular, be due to tolerances, in which case not only tolerances on positioning may be compensated for but also tolerances on attitude, i.e. particularly deviations from the intended parallelism between the two printed circuit boards and between the contact-making regions arranged thereon which are associated with the given contact device. Because of the design according to the invention of the outer conductor 2 of the contact devices, where there is a plurality of individually deformable contact elements, it is also possible for these tolerances on attitude to be comparatively large. The point contact which the spherical head 5 of the center conductor 1 makes is likewise insensitive to departures such as were mentioned.

As the resilient tongues 11 are deformed, a sliding takes place and hence a relative movement between the sleeve part 9 of the outer conductor 2 and the resilient tongues 11 at those points at which they are resting against one another. In the embodiment shown in FIGS. 6 and 7, the points where they rest are always on the surrounding projection 13 from the sleeve part 9 of the outer conductor 7. Depending on the deformation of the resilient tongues 11, said surrounding projection 13 thus makes contact with different points on the resilient tongues 11, provision being made for the resting to take place only within that section in which the resilient tongues 11 extend in parallel. In the embodiments shown in FIGS. 8 to 11, the resting points are, by contrast, always formed by the radiused end sections of the resilient tongues 11 which, depending on the deformation of the resilient tongues 11, touch the outside of the sleeve part 9 of the outer conductor 2 at different points.

In the embodiments shown in FIGS. 8 to 11, provision is also made for the surrounding projection 13 on the sleeve part 9 of the common conductor 7 to form an abutment for the expansion of the resilient tongues 11. In conjunction with the component of force which the resilient pre-loading of the resilient tongues 11 in the radial direction exerts against the sleeve part 4 of the outer conductor 2, the resilient tongues 11 are thus able to be held under pre-loading even in the unloaded state, i.e. when they are not arranged between two suitably spaced printed circuit boards.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A contact device comprising a plurality of contact elements via each of which two points of contact on an outer conductor of the contact device are connected electrically, the points of contact being intended to make contact with contact-making regions of components, the contact elements each having a first section which connects the points of contact electrically and which is at least partly in the form of a resilient tongue, and second sections at least a section or sections of which are formed by a common conductor and which connect the points of contact electrically, wherein the common conductor surrounds a center conductor and is electrically insulated therefrom, the paths of connection formed by the second sections being shorter than those formed by the first sections.

2. The contact device of claim 1, wherein the contact elements are so arranged that their first sections surround their second sections annularly.

3. The contact device of claim 2, wherein the first sections of a first subset of the contact elements surround the second sections of the contact elements annularly and the first sections of a second subset of the contact elements surround the first sections of the first sub-set annularly.

4. The contact device of claim 3, wherein the first sections of the first subset of the contact elements and the first sections of the second subset thereof are offset in rotation from one another.

5. The contact device of claim 1, wherein the common conductor is of a rigid form and forms, at a first end, a point of contact for contact with a first one of the contact-making regions, and the first sections of the contact elements, in the form of resilient tongues, are fastened to the common conductor.

6. The contact device of claim 1, wherein the first sections of the contact elements project beyond one end of the common conductor.

7. The contact device of claim 1, wherein the first sections of the contact elements rest against a section of the common conductor under spring loading and are movable relative thereto.

8. The contact device of claim 1, wherein the center conductor takes the form of a spring-loaded contact pin.

9. The contact device of claim 4, wherein the common conductor is of a rigid form and forms, at a first end, a point of contact for contact with a first one of the contact-making regions, and the first sections of the contact elements, in the form of resilient tongues, are fastened to the common conductor.

10. The contact device of claim 9, wherein the first sections of the contact elements project beyond one end of the common conductor.

11. The contact device of claim 10, wherein the first sections of the contact elements rest against a section of the common conductor under spring loading and are movable relative thereto.

* * * * *